US011980994B2

(12) United States Patent
Kolthoff

(10) Patent No.: US 11,980,994 B2
(45) Date of Patent: May 14, 2024

(54) SUPPORT PLATE

(71) Applicant: Kolthoff GmbH, Flüelen (CH)

(72) Inventor: Dieter Kolthoff, Flüelen (CH)

(73) Assignee: Kolthoff GmbH, Flüelen (CH)

( * ) Notice: Subject to any disclaimer, the term of this patent is extended or adjusted under 35 U.S.C. 154(b) by 323 days.

(21) Appl. No.: 17/346,538

(22) Filed: Jun. 14, 2021

(65) Prior Publication Data

US 2021/0394337 A1 Dec. 23, 2021

(30) Foreign Application Priority Data

Jun. 18, 2020 (DE) ..... 20 2020 103 506.1

(51) Int. Cl.
*B24B 41/047* (2006.01)

(52) U.S. Cl.
CPC ..... *B24B 41/047* (2013.01)

(58) Field of Classification Search
CPC ..... B24B 41/047; B24B 55/00; B24B 23/02; B24B 23/022; B24B 23/028; B24B 19/26; B24D 11/02
USPC ..... 451/353, 357, 359, 8
See application file for complete search history.

(56) References Cited

U.S. PATENT DOCUMENTS

| | | | | |
|---|---|---|---|---|
| 6,250,295 | B1 | 6/2001 | Chanton et al. | |
| 2003/0040260 | A1 | 2/2003 | Andres | |
| 2005/0058518 | A1* | 3/2005 | Valentini | B24D 9/08 409/134 |
| 2015/0148937 | A1 | 5/2015 | Wolf | |
| 2016/0158920 | A1* | 6/2016 | Valentini | B24B 55/102 451/490 |

FOREIGN PATENT DOCUMENTS

DE 20 2006 017 622 5/2008

* cited by examiner

*Primary Examiner* — Eric J Rosen
*Assistant Examiner* — Aaron R McConnell
(74) *Attorney, Agent, or Firm* — Gudrun E. Huckett

(57) ABSTRACT

A support plate for a flexible tool that is to be rotated for surface fine machining by grinding or polishing has a plate body with a bottom side that is provided with a circumferentially extending circular contact surface for the flexible tool. A fixation device is arranged at the bottom side and detachably fixes the flexible tool to the contact surface. The plate body has a top side with a drive connector that is axially oriented in a direction of an axis of rotation of the support plate and frictionally connects the support plate to a drive. One or more fatigue markings are provided on or in the top side of the support plate.

4 Claims, 2 Drawing Sheets

SUPPORT PLATE

BACKGROUND OF THE INVENTION

The invention relates to a support plate for rotating flexible tools for surface machining such as grinding or polishing. The support plate is provided at the bottom side with a circumferentially extending circular contact surface for the tool and with a fixation device provided for detachably fixing the tool at the contact surface. At the top side, the support plate comprises an axially oriented drive connector for frictional connection of the support plate to a drive.

Such a support plate is disclosed, for example, in DE 20 2006 017 622 U1. As flexible tools for surface fine machining, circular grinding disks or polishing disks are employed here. The grinding disks or polishing disks wear during normal operation but the support plate does not. In this context, a tool that is no part of the support plate and that is in the form of a grinding or polishing disk is detachably arranged at the support plate; the support plate together with the tool is subsequently connected with frictional connection via the drive connector to a hand drill or a hand grinder as rotating drives for rotating the support plate.

The invention has the object to configure a support plate of the aforementioned kind so as to be safer in regard to handling.

SUMMARY OF THE INVENTION

In accordance with the invention, this is achieved by a support plate of the aforementioned kind that is provided additionally with one or a plurality of fatigue markings that are provided on or in the top side of the support plate. Further advantageous embodiments are disclosed in the dependent claims.

The support plate serves to support the flexible tools from their back side so that during grinding or polishing with these tools a sufficient pressure can be applied onto the surface to be machined. The grinding or polishing disks which are provided as flexible tools are usually consumed in this context and, after they are spent, are replaced by new grinding or polishing disks. The support plate itself in normal use has no contact with the surface to be machined and therefore is not consumed. However, it has been found in practice that signs of fatigue in the form of small material chippings or small fissures may occur over time in the rim region of the support plate. Should they project too far in the direction toward the axis of rotation of the support plate, there is an increased risk of injury in operation of the support plate for the person working with the support plate. Also, with increasing signs of fatigue of the support plate, there is the risk in regard to the surface to be machined that the grinding or polishing process is no longer performed properly. By means of one or a plurality of fatigue markings which are applied in accordance with the invention on or in the top side of the support plate, the person that is operating the support plate can recognize whether the signs of fatigue of the support plate already have propagated so far in the direction toward the axis of rotation of the support plate that the support plate must be exchanged. The risk of injury for the person operating the support plate and also the risk of improper machining of a surface with the flexible tools is thus reduced.

Advantageously, the fatigue markings are provided in and/or on the top side of the support plate in the form of recesses and/or in the form of elevations so that they can be felt by an operator by touch. In this way, the fatigue markings can be identified by a person operating the support plate even when a purely visual identification means cannot be recognized anymore due to grinding dust that has collected on the top side of the support plate. The safety regarding safe handling of the support plate can thus be further increased.

In a particularly preferred embodiment of the invention, the totality of the fatigue markings has a center of gravity which is positioned on the axis of rotation of the support plate. In case of fatigue markings in the form of elevations, the center of gravity of the material that has been additionally applied to the top side of the support plate is located on the axis of rotation of the support plate. In case of recesses that are introduced into the top side of the support plate, the totality of these recesses has a fictional center of gravity in the form of the saved material and this fictional center of gravity is lying on the axis of rotation of the support plate. The fictional center of gravity is viewed as a center of gravity in the meaning of the invention. Also, combinations of elevations and recesses are possible. Due to the aforementioned configuration, no imbalance in the support plate is present due to the fatigue markings. The support plate itself advantageously has also a center of gravity which is located on the axis of rotation of the support plate.

In a particularly preferred embodiment of the invention, the fatigue markings, when viewing the support plate from above, are located within a circular ring whose outer radius corresponds to the radius of the support plate and whose inner radius is smaller by 10%, in particular by 8%, than the outer radius. In a particularly preferred embodiment of the invention, the inner radius of the circular ring is smaller by 5% or less than the outer radius in case that the diameter of the support plate is greater than 140 mm. Advantageously, in this context, at least the minimal distance of the fatigue marking from the axis of rotation corresponds to the inner radius, i.e., at least one of the fatigue markings coincides with the inner circle of the circular ring or that point of one of the fatigue markings that has the smallest distance from the axis of rotation of the support plate is positioned on the inner circle of the circular ring. Surprisingly, it has been found that signs of fatigue of the support plate in the form of hairline cracks or material chippings that do not extend all the way to the inner circle of the circular ring with precisely these dimensions do not impair a safe operation of the support plate but fatigue markings that project past this circular ring in the direction toward the axis of rotation of the support plate do.

The support plate according to the invention is preferably free of tools for grinding or polishing that are non-detachably (fixedly) connected thereto. A normal wear or predetermined consumption of the support plate thus does not occur.

The fixation device is preferably a clamping plate or a clamping nut wherein the tool can be clamped between the fixation device and the support plate for detachable fixation. Alternatively or as a supplement, the fixation device is a sticky coating, for example, a hook-and-loop fastener covering that interacts with a correspondingly adapted back side of the flexible tool, preferably in the form of a grinding or polishing disk.

Further advantageous embodiments of the invention can be taken from the dependent claims as well as from the schematic embodiments described in the following.

DESCRIPTION OF THE PREFERRED EMBODIMENTS

Figure 2:
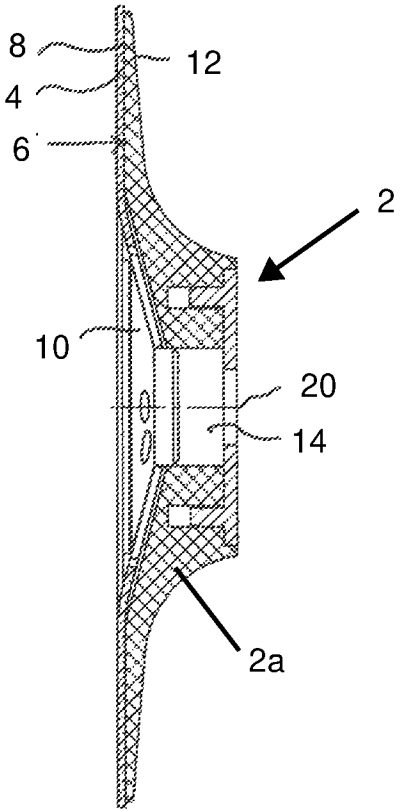
FIG. 2 shows the support plate of FIG. 1 in cross section along the section line II-II in FIG. 1.

In the following, elements of the invention that are acting in the same way are provided with the same reference character, should this be expedient. The features of the invention disclosed in the following, each individually or in any combination with each other, can be subject matter of the invention.

Figure 4:
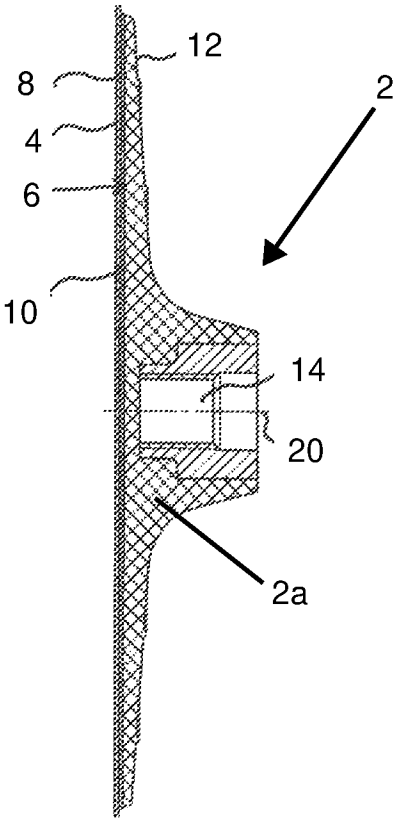
FIG. 4 shows the support plate of FIG. 3 in cross section along the section line IV-IV of FIG. 3.

FIGS. 1 to 4 show support plates 2 according to the invention for rotating flexible tools 4 for surface fine machining such as grinding or polishing. The tools 4 are illustrated in FIGS. 2 and 4. The support plates 2 comprise a plate body 2*a* with a bottom side, indicated by arrow 6, provided with a circumferentially extending circular contact surface 8, respectively. In the meaning of the invention, circumferentially extending in a circular shape means that the contact surface 8 in a plan view from below has a circumferential outer contour that is circular.

At the bottom side, the plate body 2*a* of the support plates 2 comprise a fixation device 10 that is provided for detachable fixation of the tool 4 at the contact surface 8. In the embodiment according to FIG. 2, the fixation device 10 is a clamping plate, wherein the tool 4 is clamped between this clamping plate 10 and the plate body 2*a* of the support plate 2 for detachable fixation. In the embodiment according to FIG. 4, the fixation device 10 is a hook and loop fastening system that interacts with a matching counter element provided at the tool 4.

The support plates 2 are provided at their top side 12 with an axially oriented drive connector 14 for frictional connection of the respective support plate 2 with a drive. The drive is not illustrated in the Figures and is not part of the invention. In the embodiments, a plurality of fatigue markings 16 are provided on or in the top side 12 of the support plate 2, respectively. The totality of the fatigue markings 16 has a center of gravity 18 that is located on the axis of rotation 20 of the respective support plate 2.

Figure 1:
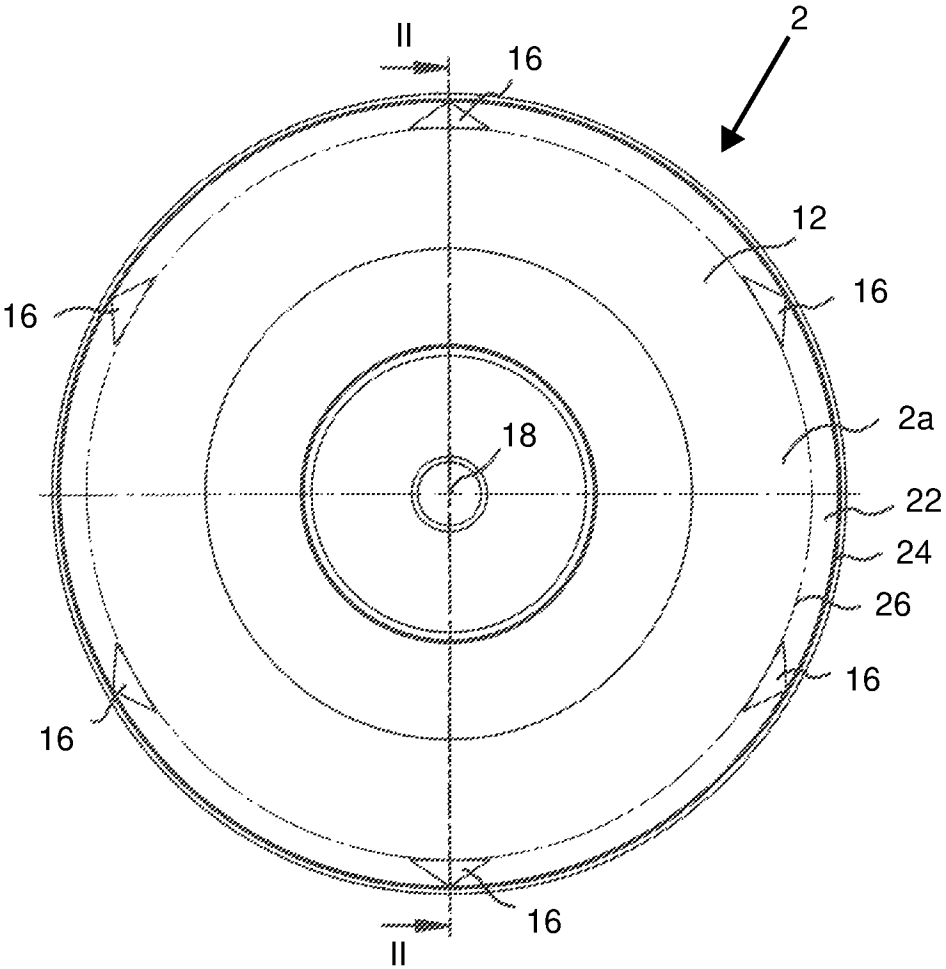
FIG. 1 shows a support plate according to the invention in a plan view from above.
Figure 3:
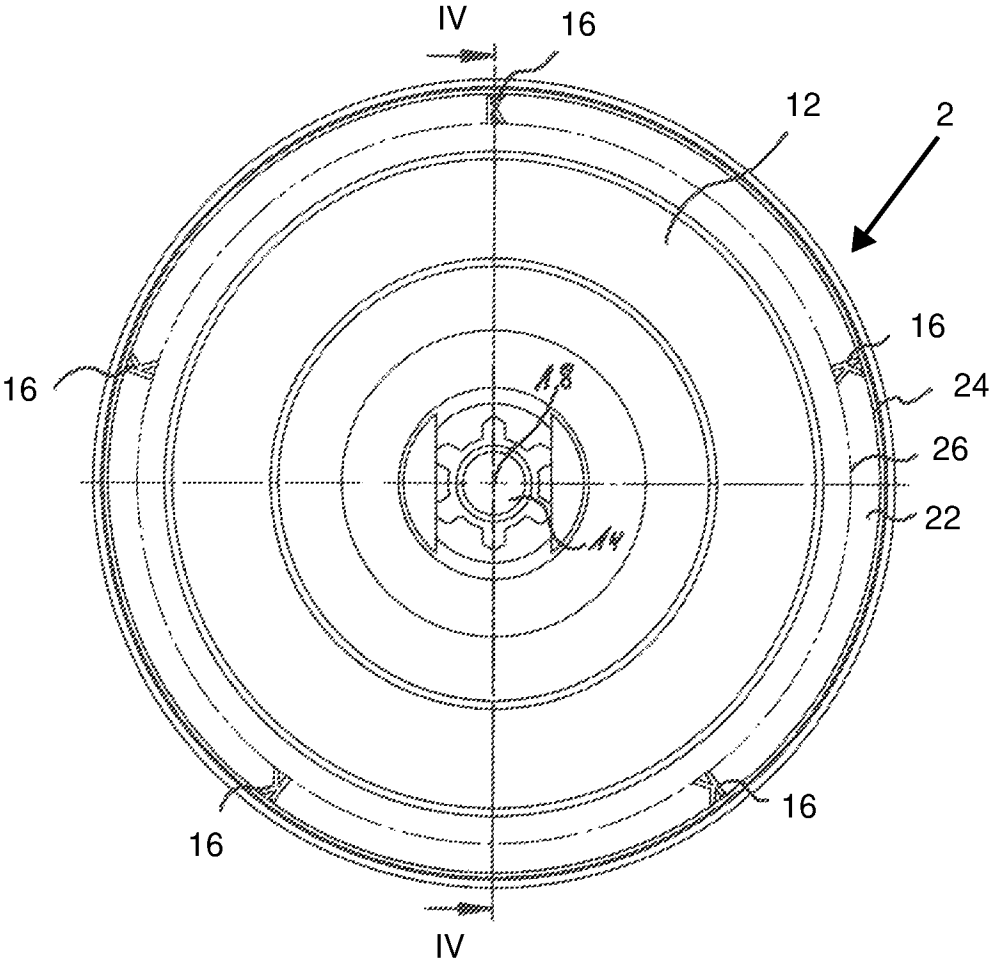
FIG. 3 shows a further support plate according to the invention in a plan view from above.

The fatigue markings 16 in a view from above onto the respective support plate 2, as in the perspective views according to FIG. 1 and FIG. 3, for example, are located inside a circular ring 22, i.e., arranged on the circular ring surface of the circular ring 22, whoseouter radius 24 corresponds to the radius of the support plate 2 and whose inner radius 26 is smaller by 10%, in particular by 8%, than the outer radius 24.

The specification incorporates by reference the entire disclosure of German priority document 20 2020 103 506.1 having a filing date of Jun. 18, 2020.

While specific embodiments of the invention have been shown and described in detail to illustrate the inventive principles, it will be understood that the invention may be embodied otherwise without departing from such principles.

LIST OF REFERENCE CHARACTERS

2 support plate
2*a* plate body
4 tools
6 bottom side
8 contact surface
10 fixation device
12 topside
14 drive connector
16 fatigue markings
18 center of gravity
20 rotation axis of the support plate
22 circular ring
24 outer radius
26 inner radius

What is claimed is:

1. A support plate for a flexible tool configured to be rotated for surface fine machining by grinding or polishing, the support plate comprising:

a plate body comprising a bottom side comprising a circumferentially extending circular contact surface configured to accommodate the flexible tool;

a fixation device arranged at the bottom side and configured to detachably fix the flexible tool at the contact surface;

the plate body comprising a top side comprising a drive connector axially oriented in a direction of an axis of rotation of the support plate and configured to frictionally connect the support plate to a drive;

one or more fatigue markings provided on or in the top side of the support plate;

wherein the fatigue markings, in a view from above onto the top side of the support plate, are arranged on a circular ring surface of a circular ring, wherein the circular ring surface of the circular ring comprises an outer radius corresponding to a maximum radius of the support plate and further comprises an inner radius that is smaller by at most 10% than the outer radius;

wherein the fatigue markings are elevations on the top side of the plate body, wherein the elevations are configured to be felt by an operator.

2. The support plate according to claim 1, wherein a totality of the fatigue markings have a center of gravity located on the axis of rotation of the support plate.

3. The support plate according to claim 1, wherein the inner radius is smaller by 8% than the outer radius.

4. The support plate according to claim 1, wherein the support plate is free of tools for grinding or polishing that are non-detachably connected to the support plate.

* * * * *